US012760518B2

(12) United States Patent
Tibah et al.

(10) Patent No.: US 12,760,518 B2
(45) **Date of Patent: *Oct. 13, 2026**

(54) METHODS FOR REHABILITATING AND/OR REMEDIATING ROOFING MATERIALS

(71) Applicant: BMIC LLC, Dallas, TX (US)

(72) Inventors: Denis Muki Tibah, Waxahachie, TX (US); Ramil Marcelo L. Mercado, Waxahachie, TX (US); Jarod L. Krajca, Ennis, TX (US); Carl Stipe, Grapevine, TX (US); Steven E. Sparks, Midlothian, TX (US)

(73) Assignee: BMIC LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/243,190

(22) Filed: Sep. 7, 2023

(65) Prior Publication Data

US 2024/0084599 A1 Mar. 14, 2024

Related U.S. Application Data

(60) Provisional application No. 63/405,690, filed on Sep. 12, 2022.

(51) Int. Cl.
*E04D 7/00* (2006.01)
*E04G 23/02* (2006.01)

(52) U.S. Cl.
CPC ..... *E04D 7/005* (2013.01); *E04G 23/0281* (2013.01)

(58) Field of Classification Search
CPC ..... E04D 7/00; E04G 23/0281; E04G 23/02
See application file for complete search history.

(56) References Cited

U.S. PATENT DOCUMENTS

| | | | | |
|---|---|---|---|---|
| 4,038,239 | A * | 7/1977 | Coyner | C08G 18/0885 528/53 |
| 4,141,187 | A | 2/1979 | Graves | |
| 4,581,090 | A * | 4/1986 | Snyder | B05D 5/02 427/140 |
| 4,705,840 | A | 11/1987 | Buckanin | |
| 5,362,566 | A * | 11/1994 | George | C08L 95/00 428/407 |
| 5,380,552 | A * | 1/1995 | George | E04D 7/005 428/150 |
| 6,495,074 | B1 | 12/2002 | Carr | |
| 10,889,693 | B2 | 1/2021 | Lalgudi | |
| 2002/0155770 | A1 | 10/2002 | Van Niekerk | |
| 2002/0160151 | A1* | 10/2002 | Pinault | B05D 5/02 427/180 |
| 2007/0087166 | A1* | 4/2007 | Lee | C09J 125/14 428/143 |
| 2008/0060301 | A1 | 3/2008 | Wang et al. | |
| 2008/0124576 | A1 | 5/2008 | Elliott | |
| 2011/0097485 | A1* | 4/2011 | Breeden | E04D 15/07 118/206 |
| 2012/0291373 | A1* | 11/2012 | Ewing | E04D 1/20 252/586 |
| 2015/0075102 | A1 | 3/2015 | Brooks et al. | |
| 2016/0230392 | A1* | 8/2016 | Tang | C09J 7/385 |
| 2020/0362149 | A1 | 11/2020 | Jahns | |
| 2021/0095473 | A1 | 4/2021 | Zheng | |
| 2021/0171794 | A1 | 6/2021 | Cheung | |
| 2021/0254343 | A1 | 8/2021 | Zheng | |
| 2021/0332593 | A1 | 10/2021 | Kalkanoglu | |
| 2024/0082874 | A1 | 3/2024 | Tibah | |

FOREIGN PATENT DOCUMENTS

| | | | |
|---|---|---|---|
| CN | 111690122 | A | 9/2020 |
| JP | 10328586 | * | 12/1998 |
| JP | 2004083784 | A | 3/2004 |

OTHER PUBLICATIONS

Goodrum, The PMMA Revolution, IIBEC Interface, Nov. 2016, p. 12-15 (Year: 2016).*

* cited by examiner

*Primary Examiner* — Tabatha L Penny
(74) *Attorney, Agent, or Firm* — Venable LLP

(57) ABSTRACT

This invention, in embodiments, relates to a method of rehabilitating or remediating a roofing material that includes obtaining a roofing material and obtaining a coating composition comprising a polymeric resin and a carrier. The coating composition is (i) substantially free of water and (ii) in the form of a liquid at at least 23° F. The method further includes applying the coating composition to the roofing material to prepare a coated roofing material, and exposing the coated roofing material to a reaction generator to polymerize the coating composition and thereby solidify the coating composition on the coated roofing material.

16 Claims, 3 Drawing Sheets

METHODS FOR REHABILITATING AND/OR REMEDIATING ROOFING MATERIALS

This application claims the priority of U.S. provisional application Ser. No. U.S. 63/405,690 entitled "Methods for Rehabilitating and/or Remediating Roofing Materials" filed Sep. 12, 2022, which is incorporated herein by reference in its entirety for all purposes.

FIELD OF THE INVENTION

This invention relates to methods for rehabilitating and/or remediating roofing materials in place, including, e.g., weathered roofing materials, without replacing the existing weathered roof covering. The methods include applying a coating composition to the roofing material, with the coating composition having a polymeric resin and a carrier, and polymerizing the coating composition using a reaction generator.

BACKGROUND OF THE INVENTION

Roofing materials that are weathered or degraded are typically replaced with new roofing materials.

SUMMARY OF THE INVENTION

One embodiment of this invention pertains to a method of rehabilitating or remediating a roofing material that includes (a) obtaining a roofing material, (b) obtaining a coating composition comprising a polymeric resin and a carrier, wherein the coating composition is (i) substantially free of water and (ii) in the form of a liquid at at least 23° F., (c) applying the coating composition to the roofing material to prepare a coated roofing material, and (d) exposing the coated roofing material to a reaction generator to polymerize the coating composition and thereby solidify the coating composition on the coated roofing material.

In one embodiment, during the step of applying the coating composition to the roofing material, the coating composition does not saturate the roofing material.

In one embodiment, the coating composition is further converted into an emulsion. In an embodiment, the method further comprises exposing the coating composition to a drying source to thereby solidify the coating composition on the coated roofing material.

According to an embodiment, the coating composition is in the form of a liquid at at least 59° F.

In one embodiment, the reaction generator comprises at least one of (i) a catalyst or activator, (ii) one or more of a curing agent or a crosslinking agent or a curing membrane, (iii) a temperature of at least 23° F., (iv) air, (v) moisture, (vi) light, (vii) radiation, or (viii) any combination of (i), (ii), (iii), (iv), (v), (vi) or (vii).

In one embodiment, the carrier comprises a natural oil, a natural resin, a natural wax, a synthetic oil, a synthetic resin, a synthetic wax, or a combination thereof.

In one embodiment, the roofing material is attached to a roof prior to the step of applying the coating composition to the roofing material.

In one embodiment, the method further comprises applying roofing granules to the coated roofing material. According to another embodiment, the step of applying roofing granules to the coated roofing material occurs prior to the step of exposing the coated roofing material to a reaction generator (e.g., a curing or crosslinking agent) to polymerize the coating composition. According to another embodiment, the method further comprises removing excess roofing granules from the coated roofing material. According to an embodiment, the step of applying roofing granules to the coated roofing material is conducted by applying the roofing granules via a force action to embed the roofing granules in the coated composition. According to one embodiment, the force action comprises a pump sprayer.

In one embodiment, the polymeric resin comprises at least one of an acrylic, a methacrylate, urethane, polyvinyl butyral coating, polyvinyl butyral emulsion, isocyanate, epoxy, ester, alcohol, polyamides, polyimide, carboxylic acid, acid anhydride, aldehydes, vinyl chemistries, polyolefins, or combinations thereof. According to an embodiment, the polymeric resin comprises polymethyl methacrylate (PMMA).

In one embodiment, the coating composition further comprises one or more of a solvent, an oil, a wax, a filler, a fire retardant, an antioxidant, an anti-Ultraviolet light agent (e.g., a blocker, quencher or absorber), an anti-bacterial agent, an anti-algae agent, or a combination thereof.

In one embodiment, the coating composition further comprises a filler in an amount of 30 percent to 60 percent by weight of the total weight of the coating composition.

In one embodiment, the coating composition has a viscosity of at least 10 cP when in the form of a liquid. In another embodiment, the coating composition has a viscosity of at least 200 cP when in the form of a liquid.

In one embodiment, the step of applying the coating composition to the roofing material is conducted via at least one of spray application, brush application, or roll application.

In an embodiment, the coating composition further comprises a coloring agent.

In one embodiment, the coated roofing material exhibits an increase in thickness (mils) and weight (grams per unit of area) once the coating composition solidifies on the coated roofing material.

In one embodiment, the coated roofing material exhibits an increase in cross-machine direction (CD) tear (gf) and machine direction (MD) tensile (lbf) once the coating composition solidifies on the coated roofing material.

In one embodiment, the roofing material comprises at least one of weathered roofing shingles or dilapidating roofing shingles.

Another embodiment of this invention pertains to a method of waterproofing a roofing material that includes (a) obtaining a roofing material, (b) obtaining a coating composition comprising a polymeric resin and a carrier, wherein the coating composition is (i) substantially free of water and (ii) in the form of a liquid at at least 23° F., (c) applying the coating composition to the roofing material to prepare a coated roofing material, and (d) exposing the coated roofing material to a reaction generator to polymerize the coating composition and thereby solidify the coating composition on the coated roofing material.

According to an embodiment, the coating composition is in the form of a liquid at at least 59° F.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Figure 1:
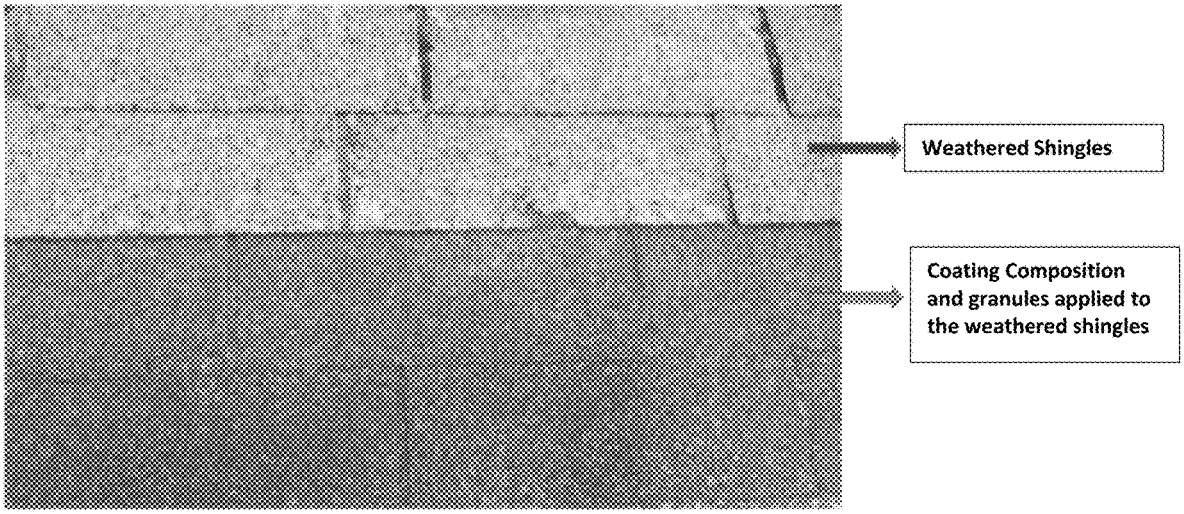
FIG. 1 is a photograph of a rehabilitated and/or remediated roofing material according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "coated substrate" means a substrate that is coated on one side (upper surface or lower surface) or both sides (upper surface and lower surface) with a coating composition.

As used herein, the term "uncoated substrate" means a substrate that has not been coated on any side (upper surface and/or lower surface) with a coating composition.

As used herein, the term "roofing material" includes, but is not limited to, shingles, roofing membranes, including, e.g., waterproofing membranes, and underlayment.

As used herein, the term "aqueous" means a composition that includes some amount of water.

As used herein, the term "non-aqueous" means a composition that is "free of water" and/or "substantially free of water."

As used herein, the term "free of water" means a composition that has less than 1% by weight of water.

As used herein, the term "substantially free of water" means a composition that has less than 5% by weight of water.

As used herein, the term "polymeric resin" means any pre-polymeric resins and/or prepolymers that comprise oligomers, monomers, polymers, and mixtures of monomers and polymers.

As used herein, the term "room temperature" means a temperature that is at or about 77° F.

As used herein, the term "ambient temperature" means a temperature that is between 20° C. to 24° C. (68° F. to 75° F.).

This invention relates to methods of rehabilitating and/or remediating weathered or aged roofs which are dilapidating and/or dilapidated, without the need to replace the roof or the original weathered roof covering. This is accomplished by applying a liquid coating which may thermally or chemically cure to an appropriate stiffness. The coating is applied such that it provides a rehabilitated and/or rejuvenated layer formed on the weathered roof covering and does not saturate through the weathered roof covering. The coating may comprise one or more components, which may or may not be mixed at the point of application. The viscosity at which the coating is applied is critical for proper application and capping granules or media adhesion. After the coating is applied, mineral granules and/or other suitable capping media (materials) may be immediately broadcast or applied to be able to adhere to the coating before it stiffens or fully cures. The capping granules or media is applied in excess and embedded into the coating applied under its own weight or may be pressed into the coating by mechanical means immediately after application to improve embedment and adhesion of the capping material to the existing weathered roof covering. The capping granules or media may also be applied through a pump spray or force action such that they impact the coating with sufficient force for embedment and adhesion. The excess granules or capping media can then be swept or brushed off the roof for reuse or recycled. The fresh layer of coating and fresh layer of granules or capping materials help to improve mechanical properties of the weathered roof which translate into performance and/or improve the aesthetics of the roof covering.

According to embodiments herein, the coating of this invention comprises polymeric resin compositions that may undergo physical interaction or chemical and/or curing reactions at temperatures of at least 23° F. (and/or at ambient temperature), resulting in a suitable roofing coating. In some cases, some amount of heat is generated in situ during the reaction. As discussed, the coating may cure at at least 23° F., at ambient temperatures, and/or use the reaction-generated heat to cure into a semi-rigid or a flexible thermoplastic coating or a semi-rigid or a flexible thermoset material, depending on the composition and chemical structure of the components. The coating may be prepared by exposing a polymer, prepolymer and/or a polymeric resin to a reaction generator such as a catalyst, an activator, appropriate temperature, moisture, air, light, radiation, other appropriate curing agents or crosslinking agents, medium, or membranes, or any combination thereof. The coating of this invention can also comprise polymeric resin compositions that can be applied in hot or molten forms.

One embodiment of this invention pertains to a method of rehabilitating or remediating a roofing material that includes (a) obtaining a roofing material, (b) obtaining a coating composition comprising a polymeric resin and a carrier, wherein the coating composition is (i) substantially free of water and (ii) in the form of a liquid at at least 23° F. (or at least 35° F., in the case where the polymeric resin includes some amount of water), (c) applying the coating composition to the roofing material to prepare a coated roofing material, and (d) exposing the coated roofing material to a reaction generator to polymerize the coating composition and thereby solidify the coating composition on the coated roofing material.

In one embodiment, during the step of applying the coating composition to the roofing material, the coating composition does not saturate the roofing material.

In one embodiment, the coating composition is further converted into an emulsion. In an embodiment, the method further comprises exposing the coating composition to a drying source to thereby solidify the coating composition on the coated roofing material.

In one embodiment, the roofing material is attached to a roof prior to the step of applying the coating composition to the roofing material.

According to an embodiment, the coating composition is in the form of a liquid at at least 59° F.

In one embodiment, the carrier comprises a natural oil, a natural resin, a natural wax, a synthetic oil, a synthetic resin, a synthetic wax, or a combination thereof.

In one embodiment, the coating composition comprises the carrier in an amount of 1 percent to 8 percent by weight based on the total weight of the coating composition. In one embodiment, the coating composition comprises the carrier in an amount of 2 percent to 8 percent by weight based on the total weight of the coating composition. In one embodiment, the coating composition comprises the carrier in an amount of 3 percent to 8 percent by weight based on the total weight of the coating composition. In one embodiment, the coating composition comprises the carrier in an amount of 4 percent to 8 percent by weight based on the total weight of the coating composition. In one embodiment, the coating composition comprises the carrier in an amount of 5 percent to 8 percent by weight based on the total weight of the coating composition. In one embodiment, the coating composition comprises the carrier in an amount of 6 percent to 8 percent by weight based on the total weight of the coating composition. In one embodiment, the coating composition comprises the carrier in an amount of 7 percent to 8 percent by weight based on the total weight of the coating composition. In one embodiment, the coating composition comprises the carrier in an amount of 1 percent to 7 percent by weight based on the total weight of the coating composition. In one embodiment, the coating composition comprises the carrier in an amount of 2 percent to 7 percent by weight based on the total weight of the coating composition. In one embodiment, the coating composition comprises the carrier in an amount of 3 percent to 7 percent by weight based on the total weight of the coating composition. In one embodiment, the coating composition comprises the carrier in an amount of 4 percent to 7 percent by weight based on the total weight of the coating composition. In one embodiment, the coating composition comprises the carrier in an amount of 5 percent to 7 percent by weight based on the total weight of the coating composition. In one embodiment, the coating composition comprises the carrier in an amount of 6 percent to 7 percent by weight based on the total weight of the coating composition. In one embodiment, the coating composition comprises the carrier in an amount of 1 percent to 6 percent by weight based on the total weight of the coating composition. In one embodiment, the coating composition comprises the carrier in an amount of 2 percent to 6 percent by weight based on the total weight of the coating composition. In one embodiment, the coating composition comprises the carrier in an amount of 3 percent to 6 percent by weight based on the total weight of the coating composition. In one embodiment, the coating composition comprises the carrier in an amount of 4 percent to 6 percent by weight based on the total weight of the coating composition. In one embodiment, the coating composition comprises the carrier in an amount of 5 percent to 6 percent by weight based on the total weight of the coating composition. In one embodiment, the coating composition comprises the carrier in an amount of 1 percent to 5 percent by weight based on the total weight of the coating composition. In one embodiment, the coating composition comprises the carrier in an amount of 2 percent to 5 percent by weight based on the total weight of the coating composition. In one embodiment, the coating composition comprises the carrier in an amount of 3 percent to 5 percent by weight based on the total weight of the coating composition. In one embodiment, the coating composition comprises the carrier in an amount of 4 percent to 5 percent by weight based on the total weight of the coating composition. In one embodiment, the coating composition comprises the carrier in an amount of 1 percent to 4 percent by weight based on the total weight of the coating composition. In one embodiment, the coating composition comprises the carrier in an amount of 2 percent to 4 percent by weight based on the total weight of the coating composition. In one embodiment, the coating composition comprises the carrier in an amount of 3 percent to 4 percent by weight based on the total weight of the coating composition. In one embodiment, the coating composition comprises the carrier in an amount of 1 percent to 3 percent by weight based on the total weight of the coating composition. In one embodiment, the coating composition comprises the carrier in an amount of 2 percent to 3 percent by weight based on the total weight of the coating composition. In one embodiment, the coating composition comprises the carrier in an amount of 1 percent to 2 percent by weight based on the total weight of the coating composition.

In one embodiment, the polymeric resin comprises at least one of an acrylic, a methacrylate, urethane, polyvinyl butyral coating, polyvinyl butyral emulsion, isocyanate, epoxy, ester, alcohol, polyamides, polyimide, carboxylic acid, acid anhydride, aldehydes, vinyl chemistries, polyolefins, or combinations thereof. According to an embodiment, the polymeric resin comprises polymethyl methacrylate (PMMA).

In one embodiment, the coating composition comprises the polymeric resin in an amount of 40 percent to 80 percent by weight based on the total weight of the coating composition. In one embodiment, the coating composition comprises the polymeric resin in an amount of 50 percent to 80 percent by weight based on the total weight of the coating composition. In one embodiment, the coating composition comprises the polymeric resin in an amount of 60 percent to 80 percent by weight based on the total weight of the coating composition. In one embodiment, the coating composition comprises the polymeric resin in an amount of 70 percent to 80 percent by weight based on the total weight of the coating composition. In one embodiment, the coating composition comprises the polymeric resin in an amount of 40 percent to 70 percent by weight based on the total weight of the coating composition. In one embodiment, the coating composition comprises the polymeric resin in an amount of 50 percent to 70 percent by weight based on the total weight of the coating composition. In one embodiment, the coating composition comprises the polymeric resin in an amount of 60 percent to 70 percent by weight based on the total weight of the coating composition. In one embodiment, the coating composition comprises the polymeric resin in an amount of 40 percent to 60 percent by weight based on the total weight of the coating composition. In one embodiment, the coating composition comprises the polymeric resin in an amount of 50 percent to 60 percent by weight based on the total weight of the coating composition. In one embodiment, the coating composition comprises the polymeric resin in an amount of 40 percent to 50 percent by weight based on the total weight of the coating composition.

In one embodiment, the coating composition further comprises one or more of a solvent, an oil, a wax, a filler, a fire retardant, an antioxidant, an anti-Ultraviolet light agent (e.g., a blocker, quencher or absorber), an anti-bacterial agent, an anti-algae agent, or a combination thereof.

In one embodiment, the coating composition further comprises a filler in an amount of 20 percent to 60 percent by weight of the total weight of the coating composition. In one embodiment, the coating composition further comprises a filler in an amount of 30 percent to 60 percent by weight of the total weight of the coating composition. In one embodiment, the coating composition further comprises a filler in an amount of 40 percent to 60 percent by weight of the total weight of the coating composition. In one embodiment, the coating composition further comprises a filler in an amount of 50 percent to 60 percent by weight of the total weight of the coating composition. In one embodiment, the coating composition further comprises a filler in an amount of 55 percent by weight of the total weight of the coating composition. In one embodiment, the coating composition further comprises a filler in an amount of 20 percent to 50 percent by weight of the total weight of the coating composition. In one embodiment, the coating composition further comprises a filler in an amount of 30 percent to 50 percent by weight of the total weight of the coating composition. In one embodiment, the coating composition further comprises a filler in an amount of 40 percent to 50 percent by weight of the total weight of the coating composition. In one embodiment, the coating composition further comprises a filler in an amount of 20 percent to 40 percent by weight of the total weight of the coating composition. In one embodiment, the coating composition further comprises a filler in an amount of 30 percent to 40 percent by weight of the total weight of the coating composition. In one embodiment, the coating composition further comprises a filler in an amount of 20 percent to 30 percent by weight of the total weight of the coating composition.

In one embodiment, the reaction generator comprises at least one of (i) a catalyst or activator, (ii) one or more of a curing agent or a crosslinking agent or a curing membrane, (iii) a temperature of at least 23° F., (iv) air, (v) moisture, (vi) light, (vii) radiation, or (viii) any combination of (i), (ii), (iii), (iv), (v), (vi) or (vii).

In one embodiment, the method further comprises applying roofing granules to the coated roofing material. According to another embodiment, the step of applying roofing granules to the coated roofing material occurs prior to the step of exposing the coated roofing material to a reaction generator to polymerize the coating composition. According to another embodiment, the method further comprises removing excess roofing granules from the coated roofing material. According to an embodiment, the step of applying roofing granules to the coated roofing material is conducted by applying the roofing granules via a force action to embed the roofing granules in the coated composition. According to one embodiment, the force action comprises a pump sprayer. According to another embodiment, the granules are not pressed into the coated substrate by mechanical means. Thus, according to this embodiment, the granules embed into the coating under their own weight and adhere to the coating and are held into the coating through the physical interactions and/or chemical reactions which cure the coating into a stiffened material. In most cases, the granule loading is high such that even with higher granule loss, the retained granule coverage is a significant improvement to the existing weathered roof.

According to one embodiment, the curing process can be accelerated by increasing the amount of curing agent or the intensity of the curing energy source (i.e., the reaction generator).

In one embodiment, the coating composition further comprises a coloring agent. According to an embodiment, the coating composition and/or the polymeric resin can be colored to improve aesthetics of the applied system and the roofing material or roof covering.

In one embodiment, the coating composition has a viscosity of at least 10 cP when in the form of a liquid. In one embodiment, the coating composition has a viscosity of at least 50 cP when in the form of a liquid. In one embodiment, the coating composition has a viscosity of at least 100 cP when in the form of a liquid. In one embodiment, the coating composition has a viscosity of at least 200 cP when in the form of a liquid. In one embodiment, the coating composition has a viscosity of 500 cP to 100,000 cP when in the form of a liquid. In one embodiment, the coating composition has a viscosity of 1000 cP to 100,000 cP when in the form of a liquid. In one embodiment, the coating composition has a viscosity of 2500 cP to 100,000 cP when in the form of a liquid. In one embodiment, the coating composition has a viscosity of 5000 cP to 100,000 cP when in the form of a liquid. In one embodiment, the coating composition has a viscosity of 10,000 cP to 100,000 cP when in the form of a liquid. In one embodiment, the coating composition has a viscosity of 20,000 cP to 100,000 cP when in the form of a liquid. In one embodiment, the coating composition has a viscosity of 30,000 cP to 100,000 cP when in the form of a liquid. In one embodiment, the coating composition has a viscosity of 40,000 cP to 100,000 cP when in the form of a liquid. In one embodiment, the coating composition has a viscosity of 50,000 cP to 100,000 cP when in the form of a liquid. In one embodiment, the coating composition has a viscosity of 60,000 cP to 100,000 cP when in the form of a liquid. In one embodiment, the coating composition has a viscosity of 70,000 cP to 100,000 cP when in the form of a liquid. In one embodiment, the coating composition has a viscosity of 80,000 cP to 100,000 cP when in the form of a liquid. In one embodiment, the coating composition has a viscosity of 90,000 cP to 100,000 cP when in the form of a liquid. In one embodiment, the coating composition has a viscosity of 500 cP to 1000 cP when in the form of a liquid. In one embodiment, the coating composition has a viscosity of 500 cP to 2500 cP when in the form of a liquid. In one embodiment, the coating composition has a viscosity of 500 cP to 5000 cP when in the form of a liquid. In one embodiment, the coating composition has a viscosity of 500 cP to 10,000 cP when in the form of a liquid. In one embodiment, the coating composition has a viscosity of 500 cP to 20,000 cP when in the form of a liquid. In one embodiment, the coating composition has a viscosity of 500 cP to 30,000 cP when in the form of a liquid. In one embodiment, the coating composition has a viscosity of 500 cP to 40,000 cP when in the form of a liquid. In one embodiment, the coating composition has a viscosity of 500 cP to 50,000 cP when in the form of a liquid. In one embodiment, the coating composition has a viscosity of 500 cP to 60,000 cP when in the form of a liquid. In one embodiment, the coating composition has a viscosity of 500 cP to 70,000 cP when in the form of a liquid. In one embodiment, the coating composition has a viscosity of 500 cP to 80,000 cP when in the form of a liquid. In one embodiment, the coating composition has a viscosity of 500 cP to 90,000 cP when in the form of a liquid.

In one embodiment, the step of applying the coating composition to the roofing material is conducted via at least one of spray application, brush application, or roll application.

In one embodiment, the coated roofing material exhibits an increase in thickness (mils) and weight (grams per unit of area) once the coating composition solidifies on the coated roofing material.

In one embodiment, the coated roofing material exhibits an increase in cross-machine direction (CD) tear (gf) and machine direction (MD) tensile (lbf) once the coating composition solidifies on the coated roofing material.

In one embodiment, the roofing material comprises at least one of weathered roofing shingles or dilapidating roofing shingles.

Another embodiment of this invention pertains to a method of waterproofing a roofing material that includes (a) obtaining a roofing material, (b) obtaining a coating composition comprising a polymeric resin and a carrier, wherein the coating composition is (i) substantially free of water and (ii) in the form of a liquid at at least 23° F. (or at least 35° F., in the case where the polymeric resin includes some amount of water), (c) applying the coating composition to the roofing material to prepare a coated roofing material, and (d) exposing the coated roofing material to a reaction generator to polymerize the coating composition and thereby solidify the coating composition on the coated roofing material.

According to embodiments described herein, the materials of this invention are polymer-based coatings that are applied to the surface of a weathered roof covering as an enhancing/protective coating layer without penetrating the cross-section of the shingle or roofing material. By not penetrating the cross-section of the shingle or roofing material, there is no effect on the sealant applied to the shingles and/or the laminate adhesive bond. Granules can be applied to this coating to restore any lost granules on the weathered roof covering to thereby improve the aesthetics or to apply a new granule layer. Color can also be added to the polymeric coating to enhance the roof appearance. This polymeric coating can also be used to increase the mechanical properties of the weathered roof covering thereby increasing performance and, by extension, improving the durability of the shingle or roof covering.

According to embodiments described herein, the invention provides a method for rehabilitating and/or remediating dilapidated and/or dilapidating or weathered roofs by applying a coating that cures through a chemical reaction and/or a physical interaction to form a waterproofing layer on the existing weathered roofing material. Other protective and/or aesthetic materials such as, e.g., granules, and/or other suitable materials may be broadcast on the coating before it cures through a chemical reaction or physical interaction. Other materials which may improve flexibility and/or pliability of the weathered roofing materials may be added to the reactive coating before applying to the roof.

EXAMPLES

Specific embodiments of the invention will now be demonstrated by reference to the following examples. It should be understood that these examples are disclosed by way of illustrating the invention and should not be taken in any way to limit the scope of the present invention.

Example 1

Exemplary weathered roofing materials (e.g., shingles) were treated with a coating composition according to embodiments of the invention. The coating composition was brush-applied to weathered roofing materials followed by broadcasting with granules, thereby enabling the rejuvenation or remediation of the weathered roofing materials and, in the process, increasing the weight of the roofing materials by 5% to 50%. FIG. 1 is a photograph of exemplary untreated, weathered roofing materials (e.g., shingles) as compared to weathered roofing materials (e.g., shingles) to which a coating composition (i.e., a polymethyl methacrylate polymeric resin coating composition) and granules have been applied according to embodiments of the invention. As shown in FIG. 1, the weathered roofing materials to which the coating composition and granules have been applied exhibit an improved and/or rehabilitated appearance.

Example 2

Figure 2:
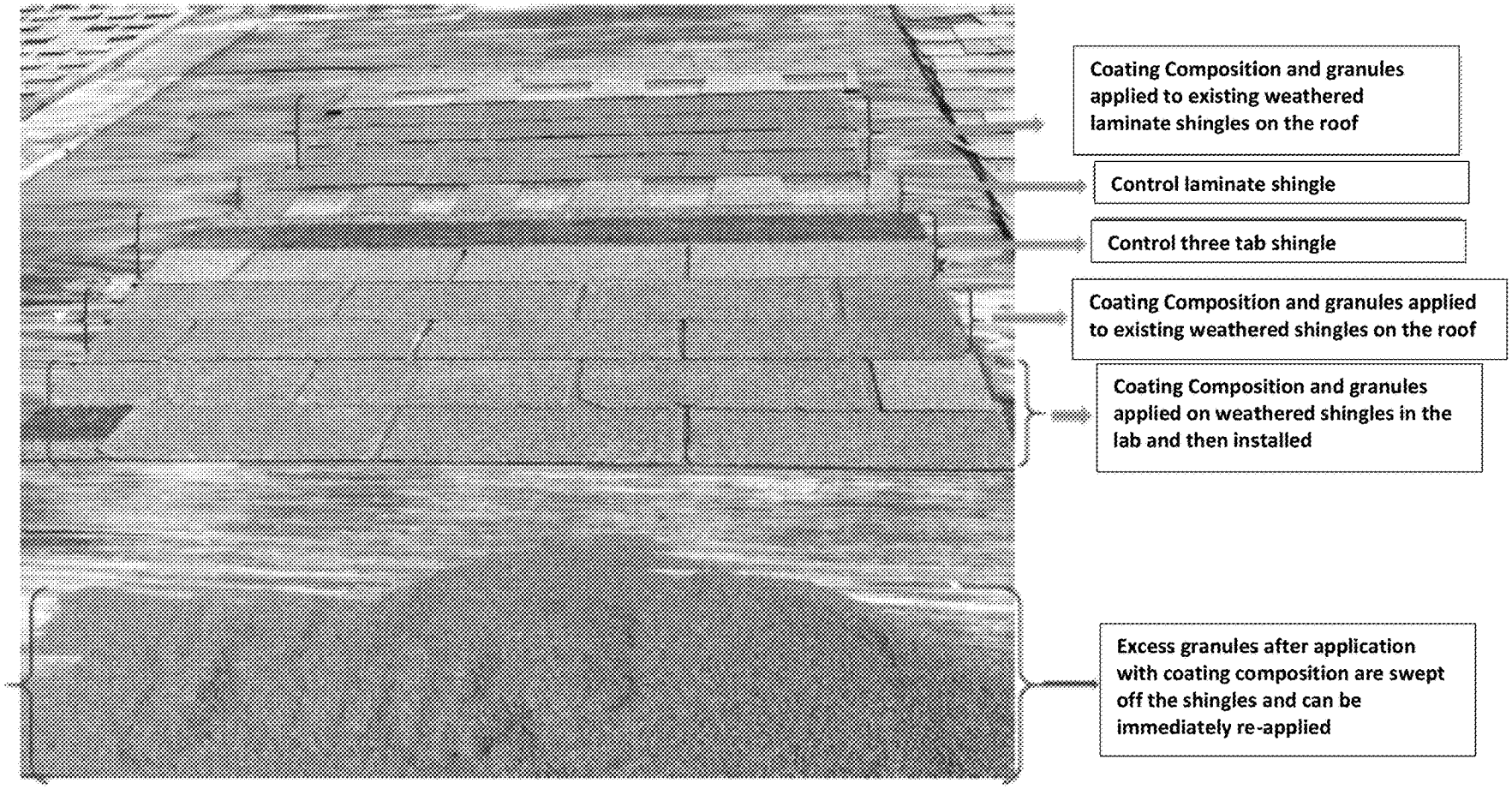
FIG. 2 is a photograph of various rehabilitated roofing materials as compared to control roofing materials according to an embodiment of the invention.

Exemplary weathered roofing materials (e.g., shingles) were treated with a coating composition according to embodiments of the invention. The coating composition was brush-applied to weathered roofing materials followed by broadcasting with granules, thereby enabling the rejuvenation or remediation of the weathered roofing materials and, in the process, increasing the weight of the roofing materials by 5% to 50%. According to this example, a control laminated shingle and a control three tab shingle were compared to (i) existing, weathered, laminated roofing shingles on a roof to which a coating composition (i.e., a polymethyl methacrylate polymeric resin coating composition) and granules have been applied according to embodiments of the invention, (ii) existing, weathered three tab roofing shingles on a roof to which a coating composition (i.e., a polymethyl methacrylate polymeric resin coating composition) and granules have been applied according to embodiments of the invention, and (iii) weathered, roofing shingles to which a coating composition (i.e., a polymethyl methacrylate polymeric resin coating composition) and granules have been applied in the lab according to embodiments of the invention. FIG. 2 is a photograph of the control laminated shingle and the control three tab shingle as compared to the three different samples of weathered roofing materials (e.g., shingles) to which a coating composition (i.e., a polymethyl methacrylate polymeric resin coating composition) and granules have been applied according to embodiments of the invention. As shown in FIG. 2, the weathered roofing materials to which the coating composition and granules have been applied exhibit a comparable appearance to the control laminated shingle and the control three tab shingle. Moreover, as shown in FIG. 2, the existing, weathered, laminated roofing shingles on the roof to which the coating composition and granules have been applied, as well as the existing, weathered roofing shingles on the roof to which the coating composition and granules have been applied exhibit an improved and/or rehabilitated appearance, as well as a comparable appearance to the weathered, roofing shingles to which the coating composition and granules have been applied in the lab. FIG. 2 further illustrates excess granules that have been swept off of the weathered roofing shingles that have been treated with the coating composition (i.e., a polymethyl methacrylate polymeric resin coating composition). As shown in FIG. 2, the excess granules can be immediately re-applied to the existing, weathered roofing shingles to which the coating composition has been applied, as well as reused and/or recycled.

Example 3

In this example, a coating composition (i.e., a polymethyl methacrylate polymeric resin coating composition) and granules were applied to existing, 15-year-old laminated shingles according to embodiments of the invention. The coating composition was brush-applied to the weathered roofing materials followed by broadcasting with granules, thereby enabling the rejuvenation or remediation of the weathered roofing materials and, in the process, increasing the weight of the roofing materials by 5% to 50%. These treated 15-year-old laminated shingles were then compared to control existing, 15-year-old laminated shingles that were untreated with such a coating composition.

The test data results of the 15-year-old laminated shingles that were rehabilitated and/or remediated according to this example, as compared to the control shingle, are shown in the following Table 1:

TABLE 1

| Property | 15-Year-Old Laminated Control Shingle | Sample 15-Year-Old Laminated Shingle Treated With Coating Composition + Regranulation |
|---|---|---|
| Shinglet Weight per unit Area (g) | 16.1 | 23.5 |
| Shinglet Thickness (mils) (ASTM 5947) | 112 | 150 |
| Granule Loss Test (g) (ASTM D4977) | 1.0 | 2.4 |
| CD Tear (gf) (ASTM D1922) | 869 | 1368 |
| MD Tensile (lbf) (ASTM D882) | 156 | 172 |

As shown in the test data results of Table 1 above, the sample 15-year-old laminated shingle that was treated with a coating composition and regranulated according to embodiments of the invention exhibited improved/increased values for cross machine direction (CD) tear (gf) and machine direction (MID) tensile strength (lbf), as well as an increased weight (g) and thickness (mils), as compared to the control shingle.

Example 4

In this example, a coating composition (i.e., a polymethyl methacrylate polymeric resin coating composition) and granules were applied, according to embodiments of the invention, to existing, non-laminated shingles that were greater than 45-years-old. The coating composition was brush-applied to the weathered roofing materials followed by broadcasting with granules, thereby enabling the rejuvenation or remediation of the weathered roofing materials and, in the process, increasing the weight of the roofing materials by 5% to 50%. These treated non-laminated shingles were then compared to control existing, non-laminated shingles that were also greater than 45-years-old, but untreated with such a coating composition.

The test data results of the non-laminated shingles that were rehabilitated and/or remediated according to this example, as compared to the control shingle, are shown in the following Table 2:

TABLE 2

| Property | >45-Year-Old Non-Laminated Control Shingle | Sample >45-Year-Old Non-Laminated Shingle Treated With Coating Composition + Regranulation |
|---|---|---|
| Shinglet Weight per unit Area (g) | 10.7 | 23.5 |
| Shinglet Thickness (mils) (ASTM 5947) | 96 | 158 |
| Granule Loss Test (g) (ASTM D4977) | 3.4 | 2.8 |
| CD Tear (gf) (ASTM D1922) | 444 | 1185 |
| MD Tensile (lbf) (ASTM D882) | 62 | 155 |

As shown in the test data results of Table 2 above, the sample non-laminated shingle that was treated with a coating composition and regranulated according to embodiments of the invention exhibited improved/increased values for cross machine direction (CD) tear (gf) and machine direction (MD) tensile strength (lbf), as well as an increased weight (g) and thickness (mils), as compared to the control non-laminated shingle.

Example 5

Figure 3:
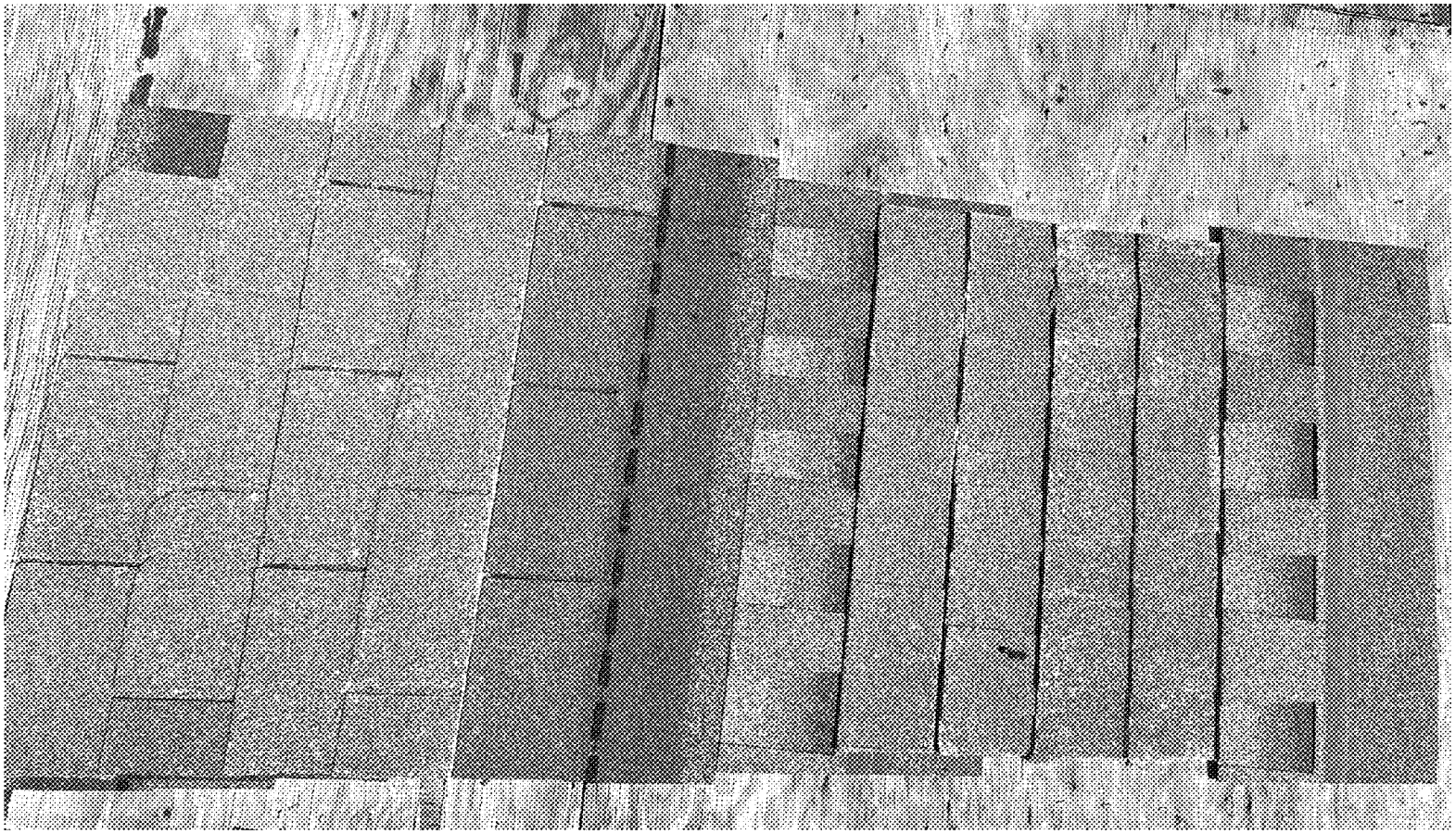
FIG. 3 is a photograph of various rehabilitated roofing materials after 22 months on a field deck according to an embodiment of the invention.

Exemplary weathered roofing materials (e.g., shingles) were treated with a coating composition according to embodiments of the invention. The coating composition was brush-applied to weathered roofing materials followed by broadcasting with granules, thereby enabling the rejuvenation or remediation of the weathered roofing materials and, in the process, increasing the weight of the roofing materials by 5% to 50%. The weathered roofing materials (e.g., shingles) treated with the coating composition were attached to a field deck and exposed to an outside environment for almost 2 years (22 months). FIG. 3 is a photograph of the different samples of weathered roofing materials (e.g., shingles), attached to a field deck, to which a coating composition (i.e., a polymethyl methacrylate polymeric resin coating composition) and granules have been applied according to embodiments of the invention, after 22 months exposure to the outside environment. As shown in FIG. 3, after 22 months, the weathered roofing materials to which the coating composition and granules have been applied exhibit an improved and/or rehabilitated appearance, as compared to, e.g., exemplary untreated, weathered roofing materials (e.g., shingles) (see, e.g., FIG. 1).

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A method of waterproofing a plurality of roofing shingles on a roof, the method comprising:

obtaining a plurality of roofing shingles, wherein the plurality of roofing shingles are attached to the roof;

obtaining a coating composition comprising a polymeric resin and a carrier, wherein the coating composition is (i) substantially free of water and (ii) in the form of a liquid at at least 23° F.;

wherein the polymeric resin comprises polymethyl methacrylate (PMMA) in an amount of 40% by weight to 80% by weight based on a total weight of the coating composition; and wherein the carrier comprises a natural oil, a natural resin, a natural wax, or a combination thereof in an amount of 1% by weight to 8% by weight based on the total weight of the coating composition;

applying the coating composition to an exposed surface of each of the plurality of roofing shingles on the roof to prepare coated roofing shingles, wherein the coating composition does not saturate the roofing shingles; and exposing the coated roofing shingles to a reaction generator to polymerize the coating composition and thereby solidify the coating composition on the exposed surface of each of the coated roofing shingles, wherein the reaction generator comprises a catalyst configured to polymerize the PMMA via a chemical reaction at ambient temperature.

2. The method according to claim 1, wherein the coating composition is in the form of a liquid at at least 59° F.

3. A method of rehabilitating or remediating a plurality of roofing shingles on a roof, the method comprising:

obtaining a plurality of roofing shingles, wherein the plurality of roofing shingles are attached to the roof;

obtaining a coating composition comprising a polymeric resin and a carrier, wherein the coating composition is (i) substantially free of water and (ii) in the form of a liquid at at least 23° F.;

wherein the polymeric resin comprises polymethyl methacrylate (PMMA) in an amount of 40% by weight to 80% by weight based on a total weight of the coating composition; and wherein the carrier comprises a natural oil, a natural resin, a natural wax, or a combination thereof in an amount of 1% by weight to 8% by weight based on the total weight of the coating composition;

applying the coating composition to an exposed surface of each of the plurality of roofing shingles on the roof to prepare coated roofing shingles, wherein the coating composition does not saturate the roofing shingles;

applying roofing granules to the coated roofing shingles;

exposing the coated roofing shingles to a reaction generator to polymerize the coating composition and thereby solidify the coating composition on the exposed surface of each of the coated roofing shingles, wherein the reaction generator comprises a catalyst configured to polymerize the PMMA via a chemical reaction at ambient temperature; and removing excess roofing granules from the coated roofing shingles.

4. The method according to claim 3, wherein the coating composition is further converted into an emulsion.

5. The method according to claim 4, wherein the method further comprises exposing the coating composition to a drying source to thereby solidify the coating composition on the coated roofing shingles.

6. The method according to claim 3, wherein the coating composition is in the form of a liquid at at least 59° F.

7. The method according to claim 3, wherein the step of applying roofing granules to the coated roofing shingles occurs prior to the step of exposing the coated roofing shingles to a reaction generator to polymerize the coating composition.

8. The method according to claim 3, wherein the step of applying roofing granules to the coated roofing shingles is conducted by applying the roofing granules via a force action to embed the roofing granules in the coated composition.

9. The method according to claim 8, wherein the force action comprises a pump sprayer.

10. The method according to claim 3, wherein the coating composition further comprises one or more of a solvent, an oil, a wax, a filler, a fire retardant, an antioxidant, an anti-Ultraviolet light agent, an anti-bacterial agent, an anti-algae agent, or a combination thereof.

11. The method according to claim 3, wherein the coating composition further comprises a filler in an amount of 30 percent to 60 percent by weight of the total weight of the coating composition.

12. The method according to claim 3, wherein the coating composition has a viscosity of at least 10 cP when in the form of a liquid.

13. The method according to claim 3, wherein the step of applying the coating composition to the roofing shingles is conducted via at least one of spray application, brush application, or roll application.

14. The method according to claim 3, wherein each of the coated roofing shingles exhibits an increase in thickness (mils) and weight (grams per unit of area) once the coating composition solidifies on the coated roofing shingles.

15. The method according to claim 3, wherein each of the coated roofing shingles exhibits an increase in cross-machine direction (CD) tear (gf) and machine direction (MD) tensile (lbf) once the coating composition solidifies on the coated roofing shingles.

16. The method according to claim 3, wherein the roofing shingles comprise at least one of weathered roofing shingles or dilapidating roofing shingles.

* * * * *